United States Patent [19]

Bonhomme

[11] Patent Number: 4,932,903

[45] Date of Patent: Jun. 12, 1990

[54] ELASTICALLY DEFORMABLE ELECTRIC CONTACT ELEMENTS FOR INCORPORATION IN CONNECTORS AND METHODS OF MANUFACTURING SAID CONTACT ELEMENTS

[76] Inventor: Francois R. Bonhomme, 6 Parc de Béarn, 92 210 Saint Cloud, France

[21] Appl. No.: 280,810

[22] Filed: Dec. 7, 1988

[30] Foreign Application Priority Data

Dec. 7, 1987 [FR] France ..... 87 16965

[51] Int. Cl.[5] ..... H01R 13/00

[52] U.S. Cl. ..... 439/629; 439/825

[58] Field of Search ..... 439/629–637, 439/816, 825

[56] References Cited

U.S. PATENT DOCUMENTS 3,418,623 12/1968 Ruehlemann ..... 439/825
3,517,374 6/1970 Bonhomme .
3,543,226 11/1970 Laboue .
3,626,361 12/1971 Bonhomme .
3,820;061 6/1974 Holden ..... 439/825
4,066,327 1/1978 Soes ..... 439/825

FOREIGN PATENT DOCUMENTS 0213820 3/1987 European Pat. Off. .

*Primary Examiner*—Joseph H. McGlynn
*Attorney, Agent, or Firm*—Larson and Taylor

[57] ABSTRACT

The electric contact element (1*c*) is constituted by a substantially planar piece of metal obtained by blanking or punching, the contour of the part (11) of the element (1*c*) which ensures the contact with an associated contact element (socket 16, 17, 18, printed circuit board, etc.) being such that it enables the part (11) to be elastically compressed in the plane of the part, possibly after a treatment of the metal of the piece of metal (beryllium copper or the like) imparting thereto in the known manner the required elasticity after the blanking or punching operations.

16 Claims, 3 Drawing Sheets

ELASTICALLY DEFORMABLE ELECTRIC CONTACT ELEMENTS FOR INCORPORATION IN CONNECTORS AND METHODS OF MANUFACTURING SAID CONTACT ELEMENTS

The invention relates to elastically deformable contact elements for incorporation in electric connectors and cooperation in particular with contact sockets as plugs but also, as the case may be, with conductive tracks of printed circuit boards. It also relates to methods of manufacturing such contact elements.

Electric contact elements are known which are constituted by several oval loops formed by bending elastic metal wire, the ends of which are assembled in a sleeve, said loops being disposed parallel to each other so that their assembly consists of a single oval loop (French Patent No. 1,426,379 or U.S. Pat. No. 3,517,374 and its Certificates of Addition filed by the applicant). Electric contact elements are also known which are constituted by blanking a sheet and folding the sheet out of the plane of the sheet into a loop (French Patent No. 69.02462 or U.S. Pat. No. 3,626,361 and its Certificates of Addition filed by the applicant). In both cases, the elasticity of the contact element is due to the presence of the loop of wire of blanked sheet which has required at least one folding operation.

Notwithstanding their advantages, the aforementioned known contact elements have the drawback of requiring for their manufacture long and varied series of operations and relatively complicated automatic or semi-automatic machines.

An object of the invention is to provide novel electric contact elements and a method of manufacturing said elements which avoid this drawback of the known contact elements.

In one of its aspects, the invention provides an elastically deformable electric contact element which is constituted by a substantially planar piece of metal obtained by blanking or punching, the contour of the part of said piece which ensures the contact with an associated contact element (socket, printed circuit board, etc.) being such that it permits said part to be elastically compressed in its plane, possibly after a treatment of the piece of metal (beryllium copper or the like) which imparts thereto, in the known manner, the required elasticity after the blanking or punching operations.

In another of its aspects, the invention provides a method for manufacturing an elastically deformable electric contact element comprising blanking out a piece of metal from a substantially planar strip of metal by giving to the part of said piece which must ensure said contact with an associated contact element such contour that it enables said part to be elastically compressed in its plane, when the metal of said piece has been possibly subjected to a suitable treatment which imparts the required elasticity thereto.

It is true that if the strip or band of metal is of beryillium copper, the finished blanked out and shaped contact element must be heat treated. The beryllium copper is supplied in the form of a non-heat treated strip or band and is "soft" (malleable) and therefore lends itself to folding, bending and shaping. The direction of the rolling of the band is of little importance t the configuration of the piece, but the contact element may also be produced from metal such as stainless steel or phosphor bronze whose mechanical properties are not obtained by a heat treatment but by a work harding when rolling the band (band in the spring state 4/4 hard, ½ hard . . . ).

One of the advantages of the electric contact element according to the invention is that, as it is not subjected to a shaping, (i.e. bending), it can be produced from a metal in the spring state. There is no danger of initiation of mechanical fractures since there are no folds.

Thus it will be understood that the electric contact elements according to the invention may be easily manufactured with the method according to the invention by simple blanking out operations carried out in succession on the same punching press, possibly followed by a conventional treatment, with no need to proceed to the usual operations involving deforming or folding the blanked piece out of its plane, in contrast to the solution disclosed in said French Patent No. 69.02462, which permits for this purpose the use of automatic punching presses of simplified design.

The invention will now be described in more detail with reference to the accompanying drawings in which.

Figure 1:
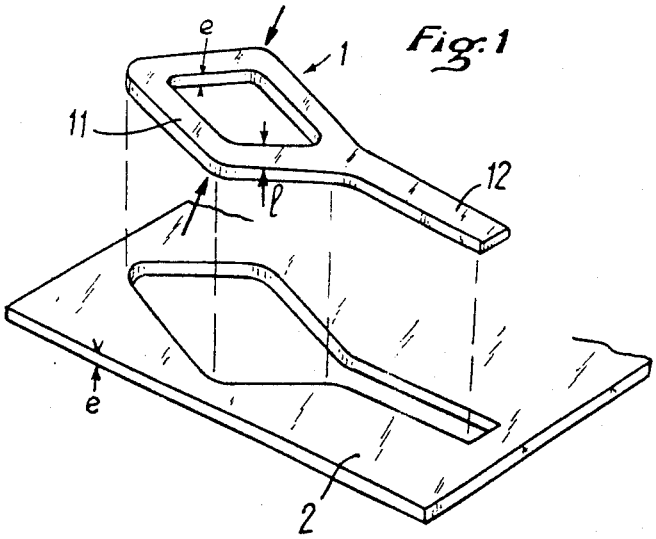
FIG. 1 is a perspective view of a contact element according to the invention and the metal band from which it has been blanked out.

As shown diagrammatically in FIG. 1, the electric contact element 1 according to the invention consists of a substantially planar piece of metal (or metal alloy) obtained by blanking or punching (as will be explained in detail with reference to FIGS. 15 and 16), the contour of the part 11 of this element which ensures the contact with an associated contact element (as will be explained in detail with reference to FIGS. 13 and 14) being such that it enables this part to be elastically compressed in its plane, as is diagrammatically represented by the opposed arrows in FIG. 1. The remainder of the contact element 1 is formed by a stem 12 of square or rectangular cross-section adapted to be connected by soldering or by wrapping around an electric conductor.

In order to ensure that the tools employed in the blanking operation are sufficiently strong, it is advisable, as is known, to give to the width 1 measured (in a direction parallel to the plane of the initial metal strip or band 2) in the major part of the contact element 1 a value at least equal to the thickness of the element or of the metal strip 2. In order to ensure that the elastic deformation of the deformable part 11 of the contact element 1 occurs in its plane, i.e. substantially without a transverse arching or deformation, it is therefore preferable to locally weaken this deformable part 11 so that the deformation preferentially occurs in the weakened zone or the zone in which the thickness and/or width is reduced.

Figure 2:
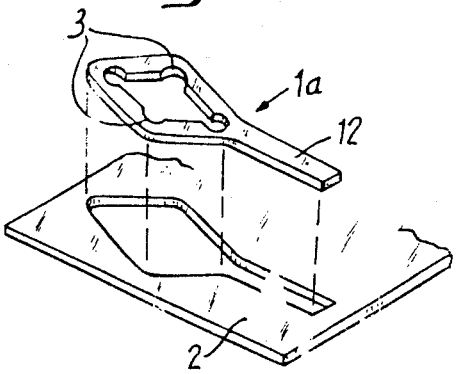
FIGS. 2 to 5 are each perspective views of a modification of the element shown in FIG. 1.
Figure 4:
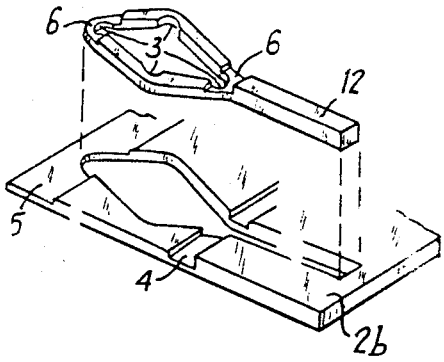
Figure 3:
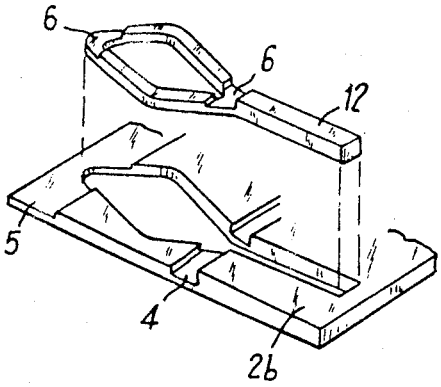
Figure 5:
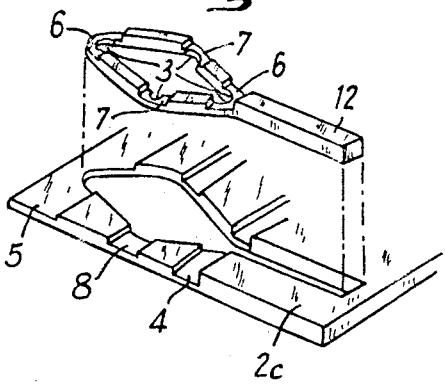

When this deformable part 11 is substantially in the form of a closed diamond-shaped loop (as shown in FIG. 1) this local weakening can be achieved by:

locally reducing the width l when blanking, for example at the four corners of the inner contour of the loop as shown at 3 in respect of the contact 1*a* of FIG. 2 or at three of the corners of outer contour;

using a profiled metal strip 2*b* having, in contrast to the metal strip 2 of FIGS. 1 and 2 and as shown in FIG. 3, a thickness reduced by a groove 4 or a step 5 in the region of the most remote corners of the diamond-shaped loop, which results in reductions 6 in the thickness e at these corners;

or combining, as shown in FIG. 4, the solutions illustrated in FIGS. 2 and 3;

or adding, as shown in FIG. 5, to the embodiment shown in FIG. 4 a reduction in the thickness 7 in the region of the other corners of the loop owing to the presence of a groove 8 suitably positioned on the initial metal strip which is here designated by the reference character 2*c*.

Those skilled in the art will understand from the foregoing how to arrange local weakenings which more or less differ from those just described to take into account the shape and the conditions of operation of the deformable part 11 of the contact elements.

Figure 12:
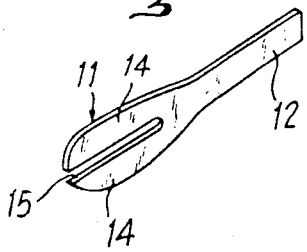

In the foregoing, it was assumed that the deformable part 11 of the contact element had a diamond-shaped closed loop form, but other forms are also possible, some of which are illustrated by way of example in FIGS. 6 to 13. In particular, FIGS. 6 to 11 and 13 illustrate deformable parts in the form of closed loops while FIG. 12 illustrates a deformable part having a shape which is other than that of a closed loop.

Figure 6:
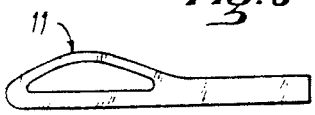
FIGS. 6 to 10 are plan views and FIGS. 11 and 12 are perspective views of various possible forms of the contact elements.
Figure 7:
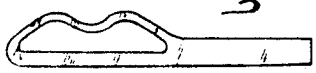
Figure 8:
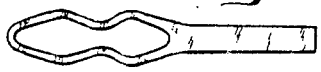
Figure 9:
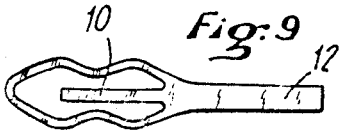
Figure 10:
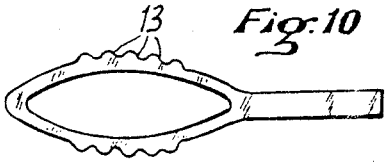

FIG. 6 represents a loop in the shape of a isosceles triangle having an obtuse apex, which provides a contact point plus a contact generatrix. FIG. 7 represents a loop constituted on one side by a rectilinear part and on the other side by a corrugated part, this loop providing two contact points plus a contact generatrix. The embodiment shown in FIG. 8, which provides two pairs of contact points, differs from that shown in FIG. 7 by the presence of two corrugated parts instead of one corrugated part. The embodiment shown in FIG. 9, which provides two pairs of contact points plus a continuity by means of two other inner contact points, differs from that shown in FIG. 8 by the presence of an appendix 10 extending the stem 11 inside the loop and capable of acting as a limiter of the inward deformation of the corrigated parts. According to the embodiment shown in FIG. 10 which provides numerous points of contact the loop has, as in the embodiments shown in FIG. 1 to 5, roughly the shape of a diamond but includes a series of local weakenings 13 which, in contrast to the embodiments shown in 2, 4 and 5, are provided outside the loop. According to the embodiment shown in FIG. 11, the loop has an oval outer shape and is rendered more easily deformable by the presence of two inner branches 13 arranged in the shape of a U which is open at the end remote from the stem 12. In the embodiment shown in FIG. 13, the contact element, here designated by the reference character 1*c*, comprises a loop of oval shape with two weakenings similar to that shown in FIG. 2.

As mentioned before, a shape other than that of a loop may be envisaged but it is in any case preferable that this shape be elongated in the direction of the stem 12, i.e. in a direction perpendicular to the direction of the deformation undergone when the contact is achieved. Thus, FIG. 12 represents a contact element whose deformable part 11 has, in the same way as the element shown in FIG. 11, an outer oval shape that is constituted by two branches 14 adjacent to the stem 12 and separated by a slot 15 whose width is sufficient to allow the deformation of the part 11 by a moving of the two branches 14 toward each other.

Figure 13:
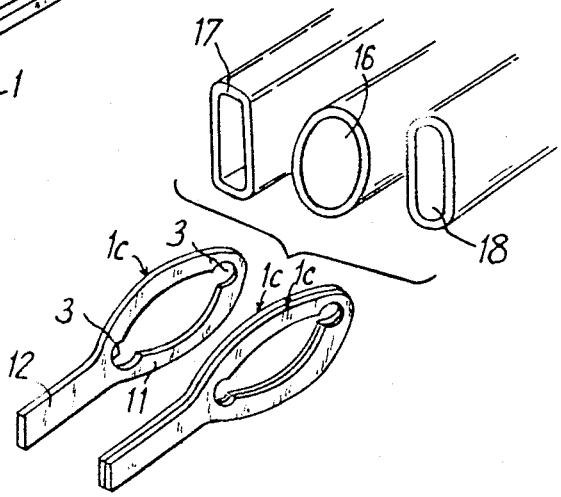

The contact elements according to the invention may be incorporated in an electric connector of conventional type; either alone (as shown on the left side of FIG. 13) or stacked with at least one identical or similar contact element (as shown on the right side of FIG. 13).

Figure 14:
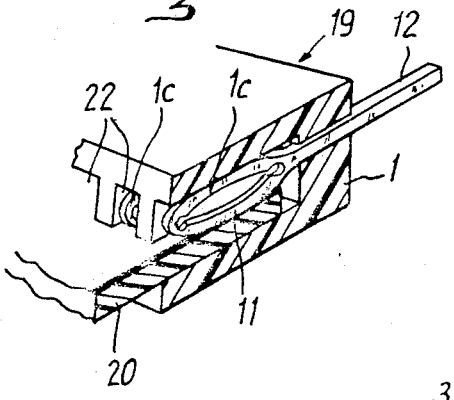
FIGS. 13 and 14 are perspective views of various possibilities of incorporation of the contact elements according to the invention in connectors.

By way of example, FIG. 13 shows in a simplified manner a connector having a plug and a plug socket and FIG. 14 represents a connector for a printed circuit board.

In FIG. 13, in which the usual insulating bodies have been omitted in order to simplify the drawing, it can be see that the contact 1*c* (or the pair of contacts 1*c*) is capable of cooperating as a plug with a preferably unsplit socket, such as a socket 16 having a circular section, a socket 17 having a roughly rectangular section or a socket 18 having a roughly oval section. The sole requirement is that the inside dimension of the socket 16, 17, or 18 be less than the corresponding outside dimension (at rest) of the deformable part of the contact element.

FIG. 14 shows a connector 19 for a printed circuit board 20 constituted by a case 21 of insulating material. In the known way, this connector comprises guide means (not shown) for the board 20 and recesses 22 for contact elements such as 1*c* whose stems 12 extend through the inner end of these recesses. The oval shape (or the diamond shape) of the deformable part 11 of each contact element 1*c* facilitates the insertion of the board 20 and the deformation of this deformable part 11 in its plane, which is perpendicular to the plane of the board.

In contrast to almost all the electric contact elements of the prior art, it is clear from FIGS. 13 and 14 that the elastic deformation produced by the achievement of the contact is obtained by exerting a pressure on the edge (or the thickness of the initial metal strip 2) and not on the width of the blanked-out contact element, which width is subsequently curved or folded (see said patent FR-A-69 02462). Consequently, there is a smaller distance between the axes of neighbouring contact elements, i.e. a decrease in the spacing or "pitch" between neighbouring contact elements of a given connector such as that shown in FIG. 14.

Figure 11:
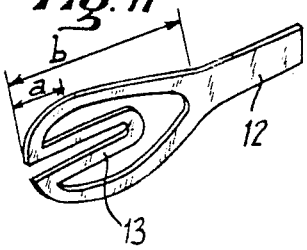

The symmetrical diamond or oval shape of the contact element shown in FIGS. 1 to 5 permits obtaining the best flexibility for a closed loop. The contact elements shown in FIGS. 11 and 12 are open in a certain length of their axis in order to ensure a good flexibility while locating the contact zone, not in the middle of the length of the deformable part 11, but very close to the front end (end located at the left of FIGS. 1 to 12 and 14 and at the right of FIG. 13: the distance a between the front end and the contact zone being advantageously between $\frac{1}{4}$ and 1/5 of the length b in the case of an open loop (FIGS. 11 and 12); while, in the case of a more or less symmetrical closed loop, this ratio reaches $\frac{1}{2}$. Indeed, if a ratio on the order of $\frac{1}{4}$ to 1/5 were provided for a closed loop, the force required for a given deformation would be much greater. What is generally termed "head contact" (FIGS. 11 and 12) is of interest when respecting certain French or U.S. standards.

Figure 15:
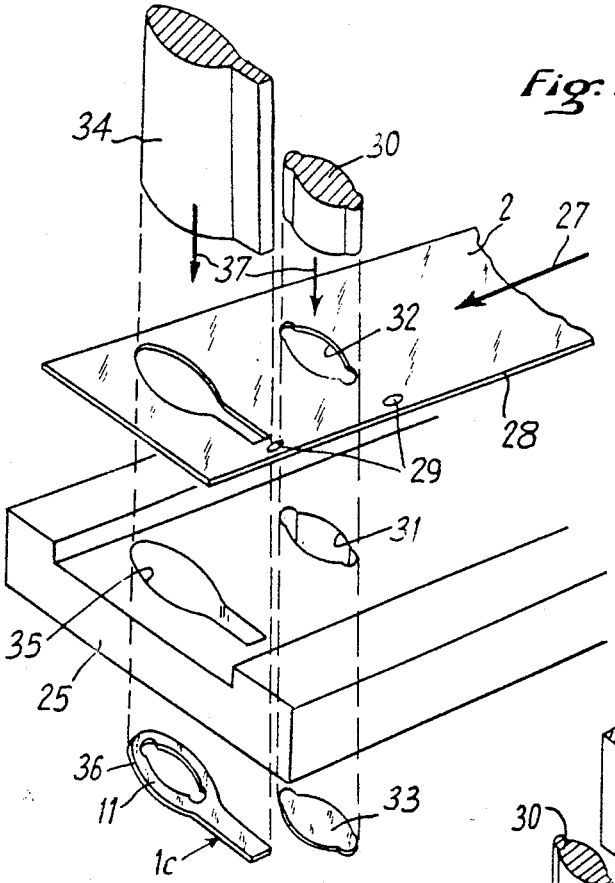
FIGS. 15 and 16 illustrate two methods for blanking out contact elements according to the invention.
Figure 16:
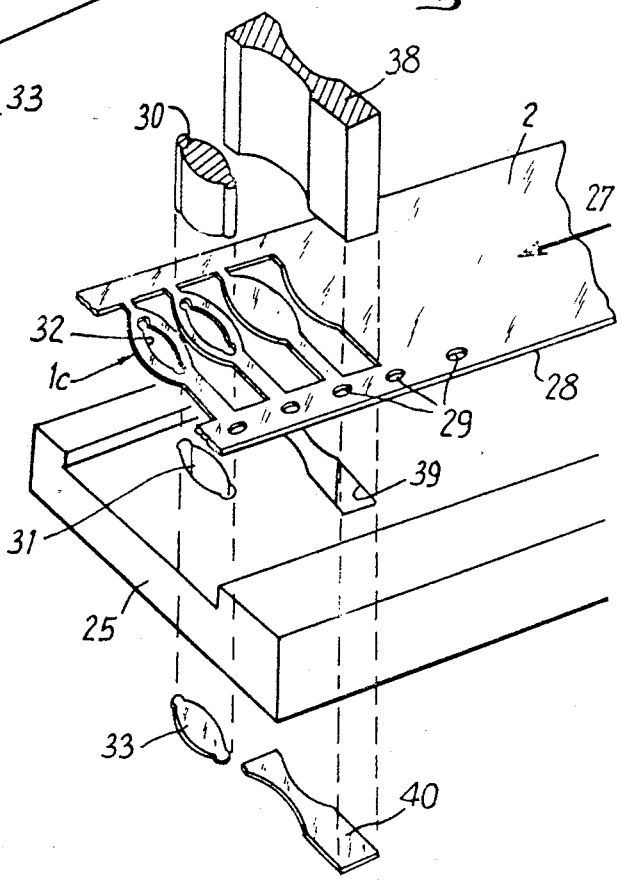

FIGS. 15 and 16 illustrate the method of manufacturing the contact elements according to the invention, it being assumed by way of example that it concerns the contact elements of 1*c* of FIGS. 13 and 14. It will be understood that those skilled in the art would be capable of adapting this method to various contact elements according to the invention, such as, in particular, those shown in FIGS. 1 to 12.

FIGS. 15 and 16 represent the essential elements of a punching press, namely a rectilinear guide 25 for a metal strip 2, means diagrammatically represented by an arrow 27 for feeding the metal strip 2 in the guide 25 (FIGS. 15 and 16 only show the strip 2 spaced away from the guide 25 in order to render the drawing more clear) and punches cooperative with dies formed in the bottom of the guide 25, these punches succeeding one another in the direction of the arrow 27 and being subjected in synchronism to a reciprocating motion in a direction perpendicular to the plane of the bottom of the guide and/or the plane of the metal strip 2. Generally, the punching press includes means (not shown) for blanking one of the edges or marginal portions 28 of the strip 2 in an as exactly rectilinear manner as possible and for forming in this strip 2 locating orifices 29 at a constant distance from the edge 28 and at a constant distance apart, these orifices 29 cooperating with means (not shown) which feed the metal strip 2 in an intermittent manner through a distance (or "pitch") equal to said distance between said orifices 29.

In the embodiment shown in FIG. 15, a first punch 30, which cooperates with a die 31, is so arranged as to form the inner contour of the deformable part 11 of the contact element 1*c* by punching out scrap 33, while a second punch 34, which cooperates with a die 35, is adapted to blank out the whole of the outer contour 36 of the contact element 1*c*, so that the contact elements 1*c* drop out onto a heap at the rate of the downward strokes (diagrammatically represented by the arrows 37) of the punches 30 and 34.

In the embodiment shown in FIG. 16, a first punch 38 which cooperates with a die 39 is so arranged as to form the major part of the outer semi-contour of two neighbouring contact elements 1*c* by punching out scrap 40 in such manner that contact element blanks 41 remain attached to the strip by their two longitudinal ends. The second punch and the second die are identical to the first punch and die 30 and 32 shown in FIG. 15 and are designated by the same reference characters. In this way, the contact elements 1*c* issue from the punching press in the direction of arrow 27 by remaining temporarily held in position by their longitudinal ends connected the remaining part of the strip 2, which facilitates subsequent treating operations (heat treatment, electrolytic protection and other operations).

It will be easily understood from FIGS. 15 and 16 that the method of manufacturing contact elements is greatly facilitated by the fact that all these steps can be carried out on the same punching press, since no folding or bending operation is required. It is clear that the manufacture of the described contact elements requires a much less complicated tooling than known contact elements.

I claim:

1. An elastically deformable contact element for incorporation in electric connectors and for cooperation with an associated contact element, in particular a contact socket, in a manner of a plug, or with a conductive track of a printed circuit board, said deformable contact element being constituted by a substantially planar piece of metal obtained by blanking or punching, said deformable contact element having a part of closed loop shape for ensuring a contact with said associated contact element, said part having a cross-sectional area which is locally reduced in regions thereof which are to be preferentially deformed such that it enables said part to be elastically compressed in the plane of the deformable contact element upon cooperation with said associated contact member.

2. A contact element according to claim 1, wherein said cross-sectional area is reduced by reducing the width of said part.

3. A contact element according to claim 1, wherein said cross-sectional area is reduced by reducing the thickness of said part.

4. A contact element according to claim 1, wherein said compressive part has an elongated shape in a direction perpendicular to a direction of the deformation said part undergoes when said part is compressed by said associated contact element.

5. A contact element according to claim 4, wherein said compressive part has a diamond shape.

6. A contact element according to claim 4, wherein said compressive part has an oval shape.

7. A contact element according to claim 4, comprising a stem extending said part, said part having an open shape at an end of said part remote from said stem and having a zone contact with said associated contact element which is located at a distance from said open end which is between ¼ and 1/5 of the length of said compressive part.

8. A method for manufacturing an elastically deformable contact element for incorporation in electric connectors and for cooperation with an associated contact element, in particular a contact socket, in a manner of a plug, or with a conductive track of a printed circuit board, said deformable contact element being constituted by a substantially planar piece of metal, said deformable contact element having a part of closed loop shape for ensuring a contact with said associated contact element, said part having a cross-sectional area which is locally reduced in regions thereof which are to be preferentially deformed such that it enables said part to be elastically compressed in the plane of the deformable contact element upon cooperation with said associated contact element, said method comprising forming said substantially planar piece of metal from a substantially planar metal strip in giving said contour to said part.

9. A method according to claim 8, wherein said forming step comprises in succession blanking a major part of an outer contour of each of two neighbouring ones of said deformable contact element from said metal strip, then punching the inner contour of each of said part which has the loop shape so as to obtain said deformable contact elements which remain temporarily held by longitudinal ends thereof to the remaining part of said metal strip.

10. A method according to claim 8, comprising treating said metal to impart thereto the required elasticity.

11. A method according to claim 8, for manufacturing a deformable contact element which has a cross-sectional area which is locally reduced in regions to be preferentially deformed upon cooperation with said associated control element, said method comprising employing a profiled metal strip having a thickness which is locally reduced.

12. A method according to claim 11, wherein said cross-sectional area is reduced by grooves in said metal strip.

13. A method according to claim 11, wherein said cross-sectional area is reduced by steps in said metal strip.

14. A method according to claim 11, wherein said forming step comprises in succession blanking a major part of an outer contour of each of two neighbouring ones of said deformable contact element from said metal strip, then punching the inner contour of each of said part which has the loop shape so as to obtain said deformable contact elements which remain temporarily held by longitudinal ends thereof to the remaining part of said metal strip.

15. A method according to claim 8, wherein said forming step comprises in succession punching an inner contour of the loop shape and blanking the whole of an outer contour of the deformable contact element so as to mass produce said deformable contact elements.

16. A method according to claim 15, comprising employing a profiled metal strip whose cross-sectional area is locally reduced.

* * * * *